US008626014B2

(12) United States Patent
Kakehi

(10) Patent No.: US 8,626,014 B2
(45) Date of Patent: Jan. 7, 2014

(54) IMAGE FORMING APPARATUS

(71) Applicant: Canon Kabushiki Kaisha, Tokyo (JP)

(72) Inventor: Yutaka Kakehi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/923,161

(22) Filed: Jun. 20, 2013

(65) Prior Publication Data

US 2013/0279931 A1 Oct. 24, 2013

Related U.S. Application Data

(63) Continuation of application No. 12/914,333, filed on Oct. 28, 2010, now Pat. No. 8,494,432.

(51) Int. Cl.
*G03G 15/00* (2006.01)

(52) U.S. Cl.
USPC ..... 399/45; 399/397

(58) Field of Classification Search
USPC ..... 399/45, 323, 397
See application file for complete search history.

(56) References Cited

U.S. PATENT DOCUMENTS 5,086,318 A * 2/1992 Takeda et al. ..... 399/303
5,249,024 A * 9/1993 Menjo ..... 399/45
5,666,621 A * 9/1997 Maekawa et al. ..... 399/303
5,740,512 A * 4/1998 Hayashi et al. ..... 399/316
5,758,252 A * 5/1998 Enomoto et al. ..... 399/407
5,822,665 A * 10/1998 Yamamoto et al. ..... 399/303
5,893,657 A * 4/1999 Matsuzawa ..... 399/18
2006/0115304 A1* 6/2006 Ahn et al. ..... 399/303
2011/0103861 A1* 5/2011 Kakehi ..... 399/400
2011/0110692 A1* 5/2011 Ideguchi ..... 399/312
2011/0293337 A1* 12/2011 Shida ..... 399/312
2011/0305488 A1* 12/2011 Kikuno ..... 399/312
2012/0093545 A1* 4/2012 Shida ..... 399/297
2012/0099907 A1* 4/2012 Ideguchi ..... 399/315
2012/0106996 A1* 5/2012 Kakehi ..... 399/49
2012/0128396 A1* 5/2012 Ideguchi ..... 399/397
2012/0141166 A1* 6/2012 Kakehi ..... 399/121
2012/0148301 A1* 6/2012 Nakaegawa ..... 399/121
2012/0155902 A1* 6/2012 Torimaru ..... 399/66

* cited by examiner

*Primary Examiner* — G. M. Hyder
(74) *Attorney, Agent, or Firm* — Canon USA Inc. IP Division

(57) ABSTRACT

In an image forming apparatus that separates a thin recording material by pushing up a transfer belt, if a position where a thick recording material separates from the transfer belt is far from a leading end of a recording-material guide, conveyability of the separated thick recording material after separation becomes stable. A stretching member is provided downstream of a push-up means and upstream of the recording-material guide in a recording-material conveying direction, and the stretching member separates a thick recording material from the transfer belt.

12 Claims, 12 Drawing Sheets

IMAGE FORMING APPARATUS

CROSS REFERENCE TO RELATED APPLICATIONS

This application is a Continuation of U.S. patent application Ser. No. 12/914,333 filed Oct. 28, 2010, which claims priority from International Application No. PCT/JP2009/068624, filed Oct. 29, 2009, both of which are hereby incorporated by reference in their entirety.

BACKGROUND OF THE INVENTION

1. Field of the Invention

The present invention relates to an image forming apparatus, such as a copying machine or a laser printer, which transfers a toner image born on an image bearing member onto a recording material by using an electrophotographic technique. More specifically, the present invention relates to an image forming apparatus including a transfer belt that performs transfer and conveyance for a recording material.

2. Description of the Related Art

In an electrophotographic apparatus in which a recording material is born and conveyed by a transfer belt stretched by a plurality of rollers, the recording material on the transfer belt is electrostatically attracted onto the transfer belt after passing through a transfer nip portion.

However, if the rigidity of the recording material is low, the recording material cannot be separated from the transfer belt only by utilizing the curvature of a separation roller for stretching the transfer belt and the rigidity of the recording material. That is, the recording material remains stuck on the transfer belt at a position of the separation roller, and this causes separation failure. Accordingly, in Japanese Patent Laid-Open No. 9-015987, as a structure for undulating the transfer belt at the separation position, a method for separating a recording material by protrusions uniformly formed on a surface of a separation roller for stretching a transfer belt is known. While the transfer belt can be undulated at the separation position by using this structure, a great local tension constantly acts on the transfer belt. As a result, transfer ability is made unstable by the influence of resistance variations due to local wear of the transfer belt.

Japanese Patent Laid-Open No. 5-119636 describes a method for deforming a cylindrical transfer-material bearing sheet, which bears a recording material, for the purpose of separating the recording material while reducing wear due to deformation. Japanese Patent Laid-Open No. 5-119636 describes a structure such that rollers are provided as push-up means capable of moving between a position to push up the transfer sheet from the inner side and a position not to push up the transfer sheet. In the method described in Japanese Patent Laid-Open No. 5-119636, the recording material is separated by pushing up the transfer sheet by the rollers, but the transfer sheet is not pushed up while the recording material is not separated. Japanese Patent Laid-Open No. 5-341664 describes a method for separating a thin recording material by a large push-up amount and separating a thick recording material by a small push-up amount in order to separate recording materials of various thicknesses without deforming a transfer-material sheet more than necessary.

When such a structure is applied to a transfer belt, push-up means capable of locally pushing up the transfer belt in a separation step is provided downstream, in a recording-material conveying direction, of a transfer member for transferring a toner image onto a recording material on the transfer belt. When the recording material has low rigidity like thin paper, the transfer belt that is being locally pushed up conveys the recording material so as to undulate the recording material and to thereby increase the stiffness of the recording material during the separation step.

However, while the push-up amount for separating the thick recording material is smaller than the push-amount for separating the thin recording material, it needs to be at least a predetermined push-up amount in order to perform separation by the local push-up motion. A protrusion formed locally in the width direction on the transfer belt by such push-up motion applies, to the transfer belt, a local load that cannot be disregarded. This accelerates local wear of the transfer belt.

Meanwhile, it is found that a thick recording material can be separated from the transfer belt by using the curvature of a stretching member for stretching the transfer belt and high rigidity of the recording material.

Accordingly, to separate a thick recording material, a structure in which the stretching member is located downstream of the transfer member and upstream or downstream of the push-up means in the conveying direction of the recording material is required. When the stretching member is provided upstream of the push-up means in order to separate a thick recording material, a recording-material guide, which guides the recording material separated from the transfer belt to a fixing device located further downstream in the recording-material conveying direction, is provided downstream of the push-up means in the recording-material conveying direction. In this case, a position where the thick recording material separates from the transfer belt becomes farther from a leading end of the recording-material guide, and the thick recording material may deviate from the separation position on the transfer belt because of the high rigidity of the recording material and the conveying force of the belt. When the thick recording material deviates, the degree of deviation varies according to the recording material, and therefore, the conveying direction fluctuates. In contrast, even if a position where a thin recording material separates from the transfer belt becomes farther from the leading end of the recording-material guide, the amount of deviation of the thin recording material does not increase. Hence, the conveying direction will not fluctuate.

Accordingly, the present invention provides an image forming apparatus that performs separation of a thin recording material from a transfer belt and separation of a thick recording material from the transfer belt at different positions and that achieves both stabilization of conveyability of the thin recording material after separation and stabilization of conveyability after separation of the thick recording material separated by a member different from a member for separation of the thin recording material.

SUMMARY OF THE INVENTION

The above-described problem of the present invention is solved by an image forming apparatus including an image bearing member configured to bear a toner image; a movable belt member configured to bear and convey a recording material; a transfer member configured to electrostatically transfer the toner image formed on the image bearing member onto the recording material born and conveyed by the belt member; a push-up member configured to push up, from an inner side, a portion of the belt member downstream of the transfer member in a conveying direction of the recording material so that a belt surface locally protrudes in a width direction of the belt member; a recording-material guide provided downstream of the push-up member in the conveying direction of the recording material and configured to guide the recording material separated from the belt member to a fixing device provided downstream in the conveying direction of the recording material; and a stretching member provided downstream of the push-up member and upstream of the recording-material guide in the conveying direction of the recording material and configured to stretch the belt member. When a recording material having a first thickness is conveyed by the belt member, the push-up member pushes the belt member so as to separate the recording material from the belt member and to deliver the recording material to the recording-material guide. When a recording material having a second thickness larger than the first thickness is conveyed by the belt member, the belt member is not pushed up by the push-up member, and the stretching member separates and delivers the recording material to the recording-material guide.

Further features of the present invention will become apparent from the following description of exemplary embodiments with reference to the attached drawings.

DESCRIPTION OF THE EMBODIMENTS

First Embodiment

Image Forming Apparatus

Figure 1:
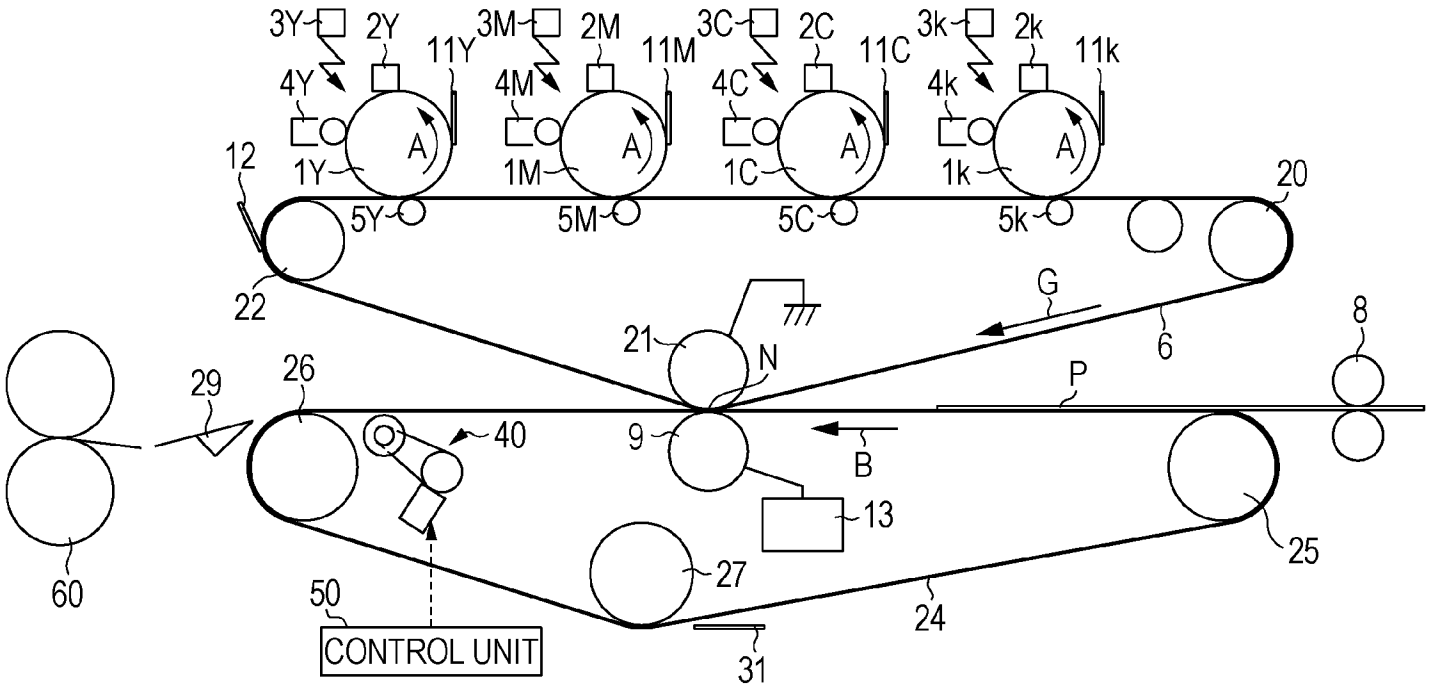
FIG. 1 is a cross-sectional view of an image forming apparatus.

A configuration and operation of an image forming apparatus according to a first embodiment will be described with reference to FIG. 1.

Photosensitive drums 1Y, 1M, 1C, and 1*k* serve as image bearing members, and rotate in directions of arrows A. Surfaces thereof are uniformly charged at a predetermined voltage by charging devices 2Y, 2M, 2C, and 2*k*, respectively. The charged surfaces of the photosensitive drums are exposed by exposure devices 3Y, 3M, 3C, and 3*k* formed by laser beam scanners, respectively, whereby electrostatic latent images are formed thereon. Outputs from the laser beam scanners are turned on or off on the basis of image information, so that electrostatic latent images corresponding to an image are respectively formed on the photosensitive drums. Developing devices 4Y, 4M, 4C, and 4*k* includes chromatic color toners of yellow (Y), magenta (M), cyan (C), and black (k), respectively. A predetermined voltage is applied to the developing devices. The above-described electrostatic latent images are developed by passing through the developing devices 4Y, 4M, 4C, and 4*k*, and toner images are thereby formed on the surfaces of the photosensitive drums 1Y, 1M, 1C, and 1*k*. A reversal developing method that performs development by sticking toner onto exposed portions of the electrostatic latent images is used.

The toner images formed on the photosensitive drums 1Y, 1M, 1C, and 1*k* are primarily transferred onto an intermediate transfer belt 6 by corresponding primary transfer rollers 5Y, 5M, 5C, and 5*k*. In this way, toner images of four colors are transferred and superimposed on the intermediate transfer belt 6.

The intermediate transfer belt 6 is arranged in contact with the surfaces of the photosensitive drums 1, and rotates at a speed of 250 to 300 mm/sec in a direction of arrow G while being stretched by stretching rollers 20, 21, and 22 serving as a plurality of stretching members. In this embodiment, the stretching roller 20 is a tension roller that adjusts the tension of the intermediate transfer belt 6 to a constant value. The stretching roller 22 is a driving roller for the intermediate transfer belt 6.

A transfer belt 24 that bears and conveys a recording material is a belt member stretched by the stretching rollers 25, 26, and 27 serving as a plurality of stretching members in a manner such as to be movable at a speed of 250 to 300 mm/sec in a direction of arrow B. The transfer belt 24 is formed of resin, such as polyimide or polycarbonate, or rubber of various kinds that contains an appropriate amount of carbon black as antistatic agent and that has a volume resistivity of 1E+9 to 1e+14 [Ω·cm] and a thickness of 0.07 to 0.1 [mm]. Further, the transfer belt 24 is formed of an elastic material whose Young's modulus measured by a tensile test method (JIS K 6301) is higher than or equal to 0.5 MPa and lower than or equal to 10 MPa.

By forming the transfer belt 24 of a member whose Young's modulus measured in the tensile test is higher than or equal to 0.5 MPa, the transfer belt 24 can be rotated while sufficiently maintaining the belt shape. In contrast, by using a member of 10 MPa or less that is sufficiently capable of elastic deformation, a recording material P is effectively undulated by a below-described separation assist device 40 so that the recording material P can be more effectively separated from the transfer belt 24. Further, the member sufficiently capable of elastic deformation is susceptible to a relaxation phenomenon when the amount of deformation is reduced from a state in which the member is deformed. Hence, wear of the transfer belt 24 due to the separation assist device 40 can be reduced.

Recording materials are stored in an unillustrated cassette. When a supply start signal is output, a recording material P is conveyed from the cassette by an unillustrated roller in response to the supply start signal, and is guided to registration rollers 8. The registration rollers 8 temporarily stop the recording material P, and then supply the recording material P to the transfer belt 24 in synchronization with conveyance of the toner images on the intermediate transfer belt 6.

On a downstream side of the registration rollers 8 in a recording-material conveying direction (direction of arrow B), a secondary transfer roller 9 is provided as a transfer member that opposes the intermediate-transfer-belt stretching roller 21 so as to form a transfer nip N where the toner images are transferred onto the recording material born on the transfer belt 24. When the recording material is conveyed to the transfer nip N, a secondary-transfer current having a polarity opposite the polarity of the toner is applied to the secondary transfer roller 9, whereby the toner images on the intermediate transfer belt 6 are electrostatically transferred together onto the recording material P. For example, a current of +30 to 60 mA is applied in this embodiment. The secondary transfer current changes because the necessary current amount varies according to the factors such as the dry condition of the recording material, environment, and amount of toner to be transferred.

The secondary transfer roller 9 is formed by an elastic layer of ion-conductive foamed rubber (NBR rubber) and a cored bar. A used transfer roller has an outer diameter of 24 mm, a roller surface roughness Rz of 6.0 to 12.0 (μm), and a resistivity of 1E+5 to 1E+7Ω measured in N/N (23° C., 50% RH) when 2 kV is applied. A secondary-transfer high-voltage power supply 13 whose supply bias is variable is attached to the secondary transfer roller 9.

When the recording material P is separated from the transfer belt 24 after transfer and is conveyed to a fixing device 60 via a guide surface of a recording material guide 29, the toner image is fixed on the recording material by a heating and pressurizing process. After the toner image is fixed, the recording material P is discharged out of the apparatus.

Structure of Separation Assist Device

In this embodiment, as a means for pushing up the transfer belt 24 so as to assist in separation from the transfer belt 24, a separation assist device 40 is provided to separate the recording material by locally pushing up and the transfer belt 24 for deformation. The separation assist device 40 is provided on a downstream side of the secondary transfer roller 9 in the recording-material conveying direction and on an inner side of the transfer belt 24.

Figure 2A:
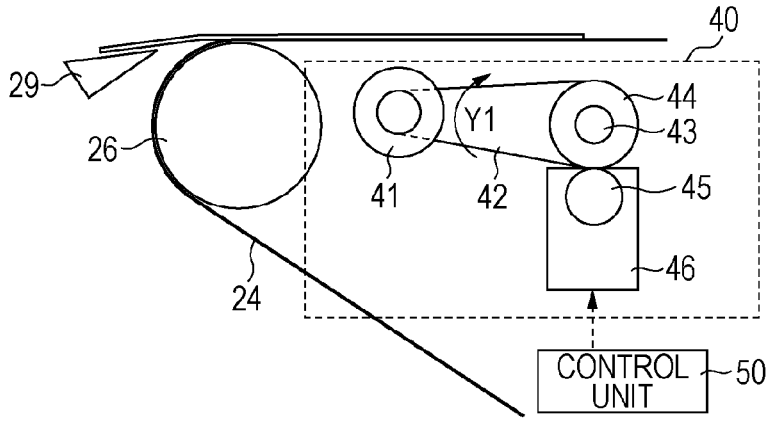
FIG. 2A is a cross-sectional view of a separation assist device 40 in a state in which separation assist rollers are at a retracted position.
Figure 2B:
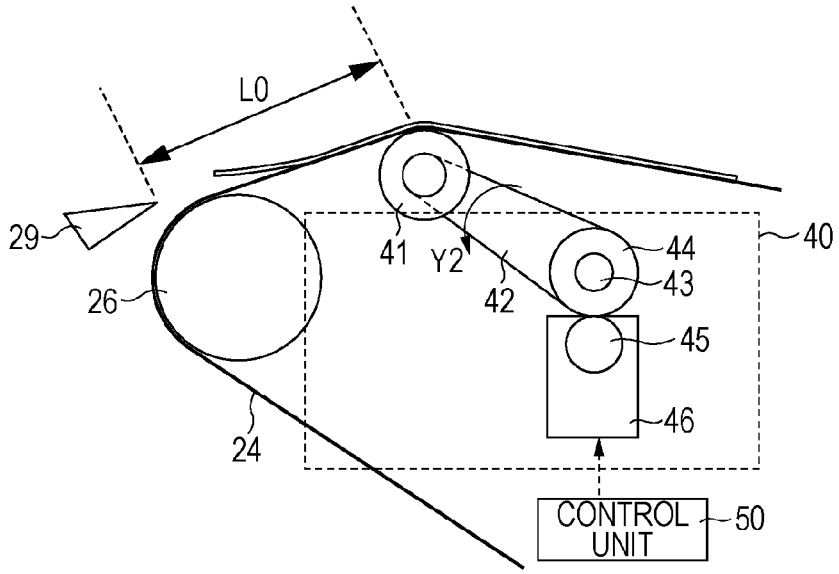
FIG. 2B is a cross-sectional view of the separation assist device in a state in which the separation assist rollers are at a push-up position.

FIGS. 2A and 2B illustrate a detailed structure and operation of the separation assist device 40. The separation assist device 40 includes a separation assist roller 41 serving as a separation member, a roller frame 42 for supporting the separation assist roller 41 rotatably, and a roller rocking center shaft 43 on which the separation assist roller 41 rocks. Also, the separation assist device 40 includes a roller driving gear 44 for rocking the separation assist roller 41 on the roller rocking center shaft 43, a motor driving transmission gear 45 for transmitting driving force to the roller driving gear 44, and a motor 46 serving as a driving source. Rotational motion of the motor 46 is transmitted to the roller driving gear 44 by the motor driving transmission gear 45. Since a bearing is provided between the roller driving gear 44 and the roller rocking center shaft 43, the roller rocking center shaft 43 does not move without any influence of rotational driving by the motor 46.

By a predetermined amount of forward rotation of the motor 46, the separation assist roller 41 and the roller frame 42 are moved on the roller rocking center shaft 43 in a direction Y1 from a roller retracted position shown in FIG. 2A to a push-up position shown in FIG. 2B where the separation assist roller 41 abuts on an inner surface of the transfer belt 24 and locally pushes up the transfer belt 24. Further, by a predetermined amount of reverse rotation of the motor 46, the separation assist roller 41 can be moved in a direction Y2 from the push-up position shown in FIG. 2B to the retracted position shown in FIG. 2A where the separation assist roller 41 separated from the transfer belt 24 is retracted. That is, the separation assist roller 41 makes such a rocking motion by forward and reverse rotations.

The separation assist roller 41 is formed of ethylene propylene rubber (EPDM), and has an outer diameter of 6 to 10 mm and a width of 5 to 15 mm. When this separation assist roller 41 pushes up the transfer belt 24, a protrusion is formed locally in the width direction in the transfer belt 24. Here, the width direction refers to a direction orthogonal to a moving direction of the moving belt surface.

In the state shown in FIG. 2A, the distance from the separation assist roller 41 to the stretching roller 26 is 4 to 8 mm. In the state shown in FIG. 2B, the separation assist roller 41 pushes up the belt surface of the transfer belt 24 from the inner side to a height of 3 to 6 mm from a flat state shown in FIG. 2A.

Since a charge having a polarity opposite the polarity of the toner is applied onto the inner surface of the transfer belt 24 by the secondary transfer roller 9, the recording material is being attracted onto the transfer belt 24 after passing through the transfer nip N. Further, a recording material having a low rigidity, such as thin paper, is susceptible to deformation. For this reason, an undulation is also formed in the recording material along a deformation formed in the transfer belt 24 locally in the width direction by the push-up motion. As a result, the second moment of area of the recording material, that is, stiffness of the recording material increases. This can obtain a separation effect that is effective for separation of a recording material having a low rigidity such as thin paper.

However, if the push-up position where the thin recording material is undulated is too far from the recording-material guide 29, a trailing edge of the recording material may pass through a protrusion forming position, where a protrusion is formed in the transfer belt 24, before a leading edge of the recording material reaches an upstream end of the guide surface of the recording-material guide 29 in the recording-material conveying direction. Here, the protrusion forming position refers to a center position in the conveying direction of a portion of the transfer belt 24 in contact with the separation assist roller 41. Conveyance of the thin recording material after separation is supported by the undulation. If the undulation gets out of shape and stiffness decreases before the recording material reaches the recording-material guide 29, conveyance failure occurs. Accordingly, it is preferable to set the distance from the upstream end of the guide surface of the recording-material guide 29 in the recording-material conveying direction to the protrusion forming position to be shorter than the smallest size in the conveying direction of the recording material usable in the image forming apparatus. Here, the distance from the upstream end of the guide surface of the recording-material guide 29 in the recording-material conveying direction to the protrusion forming position is represented by L0 in FIG. 2.

Figure 3A:
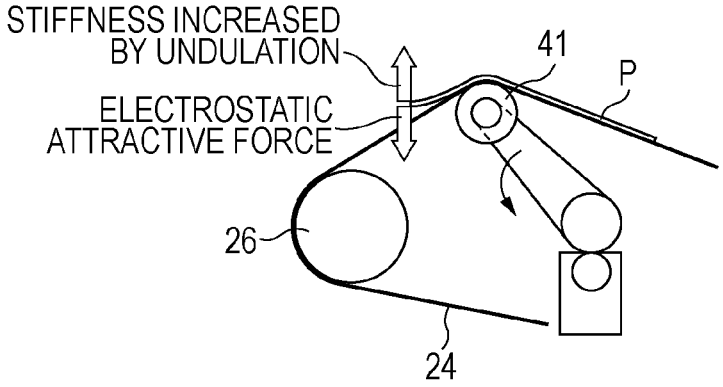
FIG. 3A illustrates a state of a recording material having low rigidity.
Figure 3B:
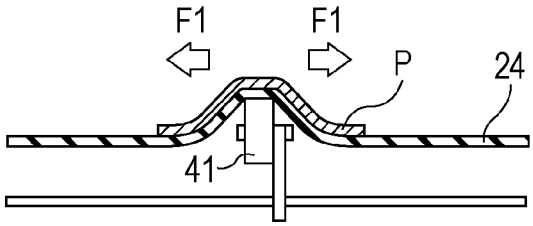
FIG. 3B illustrates the valley-shaped undulation of the recording material.

While the separation assist device 40 may have one separation assist roller 41 in an area where the recording material passes, it is preferable that a plurality of separation assist rollers 41 be arranged in the width direction within the area where the recording material passes. This will be described with reference to the drawings. FIG. 3A illustrates a state of a recording material having low rigidity, such as a thin recording material, immediately after the recording material is separated from the transfer belt 24 by being pushed up and undulated by the separation assist rollers 41.

Figure 3C:
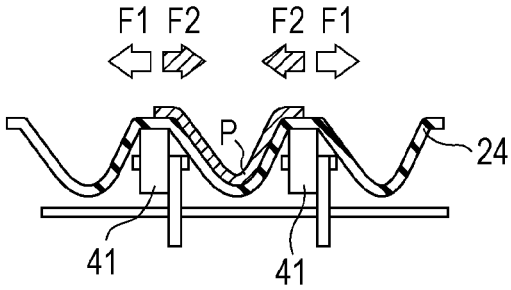
FIG. 3C illustrates the valley-shaped undulation of the recording material.

While an electrostatic attracting force from the transfer belt 24 acts on the thin recording material immediately after separation, stiffness increased by the undulation acts on in an opposite direction, thereby supporting conveyance of the thin recording material after separation. When a plurality of separation assist rollers 41 are arranged in the width direction in the area where the thin recording material passes, a valley-shaped undulation is formed in the thin recording material, as shown in FIG. 3C. The valley-shaped undulation of the recording material P is formed between protrusions formed by pushing up the transfer belt 24. Against forces F1 with which the undulation returns to the flat state, forces F2 act to hold the undulation by the protrusions of the transfer belt 24 from both sides. Therefore, the force for maintaining the undulated shape is large. However, when one separation assist roller 41 is provided in the area where the recording material P passes, as shown in FIG. 3C, a ridge-shaped undulation is formed in the recording material, but a valley-shaped undulation is not formed, so that the force for maintaining the undulated shape is small. In this case, if the leading edge of the recording material P passes over the protrusion formed by the push-up motion and is raised from the transfer belt 24, the undulation at the leading edge of the recording material easily gets out of shape. That is, the undulation of the leading edge of the recording material P passing over the push-up position immediately gets out of shape, and stiffness provided at the leading edge of the recording material is removed immediately.

When a plurality of separation assist rollers 41 are arranged, if the arrangement interval between the separation assist rollers 41 is too short, the transfer belt 24 is raised overall, and a plurality of local protrusions are not formed in the belt width direction in the transfer belt 24, so that separability cannot be enhanced. To form a plurality of local protrusions in the belt width direction, it is necessary to make the interval long.

Figure 4:
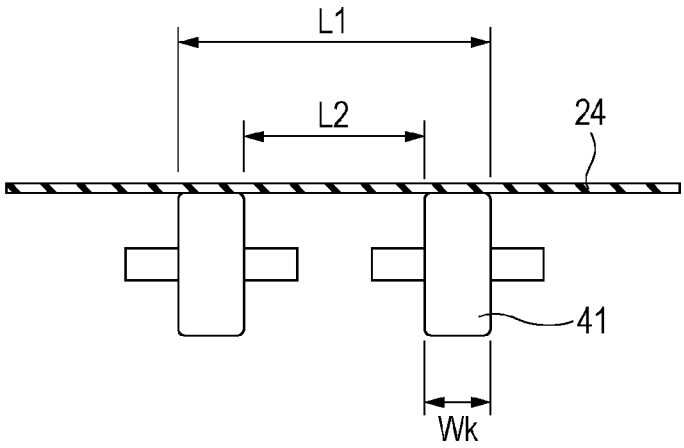
FIG. 4 illustrates the interval between the separation assist rollers 41.

In this embodiment, in a direction orthogonal to the running direction of the transfer belt 24, the width of the separation assist rollers 41 and the interval between the separation assist rollers 41 are set, as shown in FIG. 4. L1 represents the length of a portion surrounded by the separation assist rollers 41, and Wk represents the width of the separation assist rollers 41. L2 represents a portion inside opposing end faces of two adjacent separation assist rollers 41, and is given by L1−2Wk. In this embodiment, L2 is set to be 2Wk or more. That is, a length of an area where the separation assist rollers 41 are not in contact with the transfer belt 24 is larger than a length of an area where the separation assist rollers 41 are in contact with the transfer belt 24. As a result, the transfer belt 24 locally protrudes at a plurality of positions in the belt width direction rather than be raised overall. This allows the transfer belt 24 to be easily made uneven.

Figure 5A:
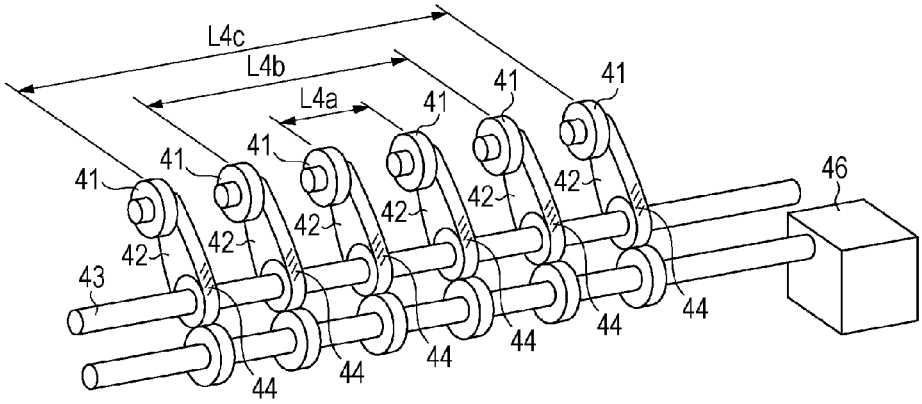
FIG. 5A is a perspective view of a separation assist device 40 according to a first embodiment.

FIG. 5A illustrates the arrangement of the separation assist rollers 41 in the width direction in this embodiment. In this embodiment, six separation assist rollers 41 are spaced in the width direction. An interval L4*a* between two adjacent center separation assist rollers 41 is 80 mm, an interval L4*b* between the second separation assist rollers 41 from the ends is 150 mm, and an interval L4*c* between the endmost separation assist rollers 41 is 250 mm. The midpoint between the endmost separation assist rollers 41, the midpoint between the second separation assist rollers 41 from the ends, and the midpoint between the two adjacent center separation assist rollers 41 coincide with the center of a recording material of any size that is conveyed in a manner such that the center thereof in the width direction substantially coincides with a common reference line.

By conveying the recording material P with the separation assist rollers 41 being thus arranged, a plurality of protrusions are formed on the transfer belt 24 so as to respond to the sizes in the width direction of the recording materials used in the image forming apparatus, from a postcard size serving as the minimum size to the maximum size having a width of 330 mm. Here, the sizes in the width direction of the recording materials used in the image forming apparatus refers to sizes of the recording materials described in the specifications or the like of the image forming apparatus.

Figure 5B:
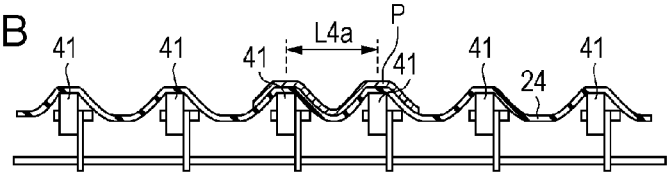
FIG. 5B illustrates the arrangement of the separation assist rollers 41 in the width direction in the first embodiment.

As shown in FIG. 5B, the interval L4*a* of 80 mm between the two center separation assist rollers 41 is shorter than a size of 100 mm in the width direction of a recording material of a postcard size that is the smallest in the sizes in the width direction of the recording materials to be conveyed. As shown in FIG. 5B, protrusions formed by push-up motions of the two center separation assist rollers 41 support both end portions in the width direction of the recording material of the postcard size, and form a valley-shaped undulation in the recording material of the postcard size.

When a recording material whose size in the width direction is more than or equal to 150 mm and less than 250 mm is conveyed, protrusions formed by push-up motions of four center separation assist rollers form valley-shaped undulations on the recording material.

Figure 5C:
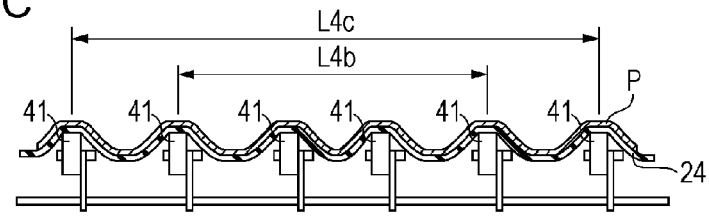
FIG. 5C illustrates the arrangement of the separation assist rollers 41 in the width direction in the first embodiment.
Figure 5D:
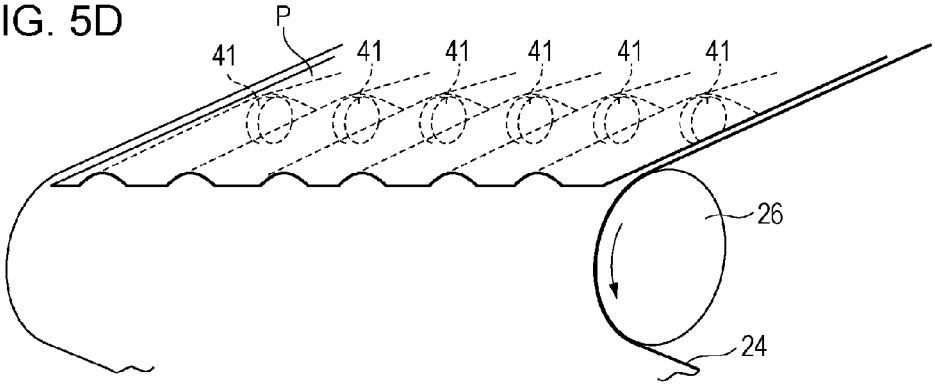
FIG. 5D is a perspective view of the recording material conveyed on the transfer belt in the first embodiment.

FIG. 5C illustrates a case in which a recording material having a width of 330 mm, whose size is the largest in the recording material sizes in the width direction used in the image forming apparatus, is conveyed. FIG. 5D is a perspective view illustrating this case. Six protrusions formed by the six separation assist rollers 41 form valley-shaped undulations in the recording material having a width of 330 mm on the transfer belt 24. Both ends of the recording material having a width of 330 mm are supported by push-up motions of the endmost separation assist rollers 41.

In the embodiment, valley-shaped undulations are thus necessarily formed in the recording materials from the postcard size as the minimum recording material size in the width direction to the maximum size having a width of 330 mm. By forming valley-shaped undulations, it is possible to suppress a phenomenon in which the undulation at the leading edge of the recording material P gets out of shape immediately after the leading edge passes over the push-up position and the stiffness given to the leading edge of the recording material is removed immediately.

In this embodiment, the recording material of the postcard size serving as the minimum size is locally raised at two different portions in the width direction, whereby one valley-shaped undulation is formed in the recording material of the postcard size as the minimum size. However, two or more valley-shaped undulations may be formed in the recording material of the postcard size as the minimum size by raising the recording material of the postcard size as the minimum size at three or more different positions in the width direction.

A phenomenon is also avoided in which the end of the conveyed recording material excessively deviates from the protrusion formed by the push-up motion of the separation assist rollers 41 and the second moment of area is not easily increased by the undulation at the edge of the recording material. For this reason, even when the recording material P has the largest one of the sizes in the width direction that are used in the image forming apparatus, undulations formed in the recording material P are not easily removed by external force such as electrostatic force. This allows the recording material P to be conveyed stably.

Control over Separation Assist Device

Figure 6:
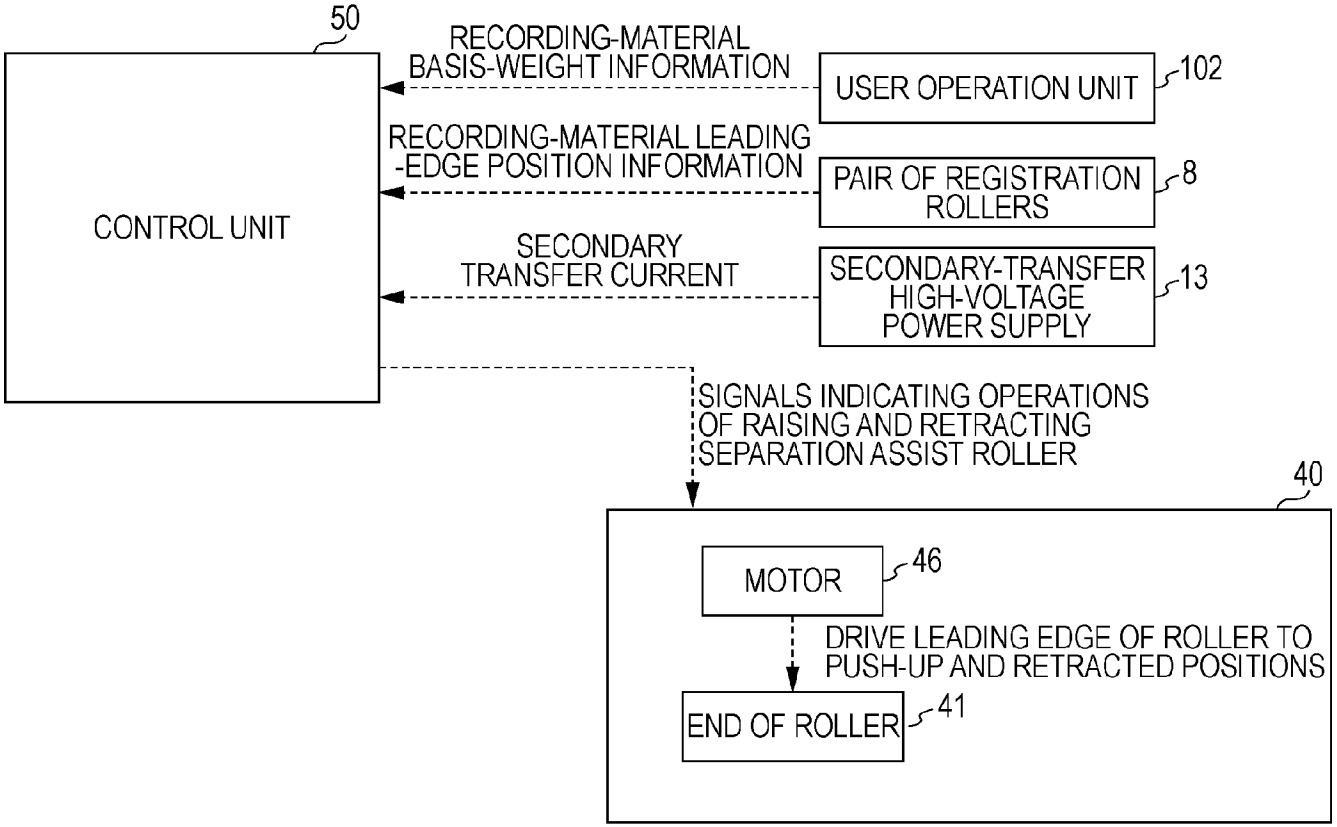
FIG. 6 explains the relationship of control in the first embodiment.

The operating position of the separation assist device 40 is controlled by a control unit 50. FIG. 6 shows the relationship of control. An operating position signal of the separation assist device 40 is controlled on the basis of basis-weight information on the recording material P specified by the user, recording-material leading-edge position information obtained on the basis of the recording material feeding timing of the pair of registration rollers 8 and the conveying speed of the recording material, and a secondary-transfer current value read by the secondary-transfer high-voltage power supply 13. The control unit 50 includes a CPU, a ROM, and a RAM. Information from an operation unit 102 by which the user operates the image forming section is input to the control unit 50. An operation timing of the registration rollers 8 is input to the control unit 50. Information about the secondary-transfer current value is input from the secondary-transfer high-voltage power supply to the control unit 50. The control unit 50 controls the operation of the motor in the separation assist device 40.

The basis weight is a unit indicating the weight (g/m$^2$) per unit area, and is generally used as a value representing the thickness of the recording material.

In this embodiment, the following two patterns are pre-stored in the ROM:

(1) When the recording material has a basis weight of 40 g/m$^2$ or less, the separation assist rollers 41 are located at a push-up position so as to protrude the transfer belt 24 locally in the width direction.

(2) When the recording material has a basis weight more than 40 g/m$^2$, the separation assist rollers 41 are located at a retracted position. At the retracted position, the separation assist rollers 41 are separate from the transfer belt 24.

That is, the separation assist rollers 41 operate to push up a recording material having a specific basis weight (first basis weight), and the separation assist rollers 41 do not operate to push up a recording material having a second basis weight larger than the first basis weight.

The basis weight is sometimes input through the operation unit 102 by the user, and the basis weight of the recording material is sometimes input to a storage portion that stores the recording material. On the basis of information about the basis weight input by the units, the control unit 50 determines the operation of the separation assist device 40.

Figure 7:
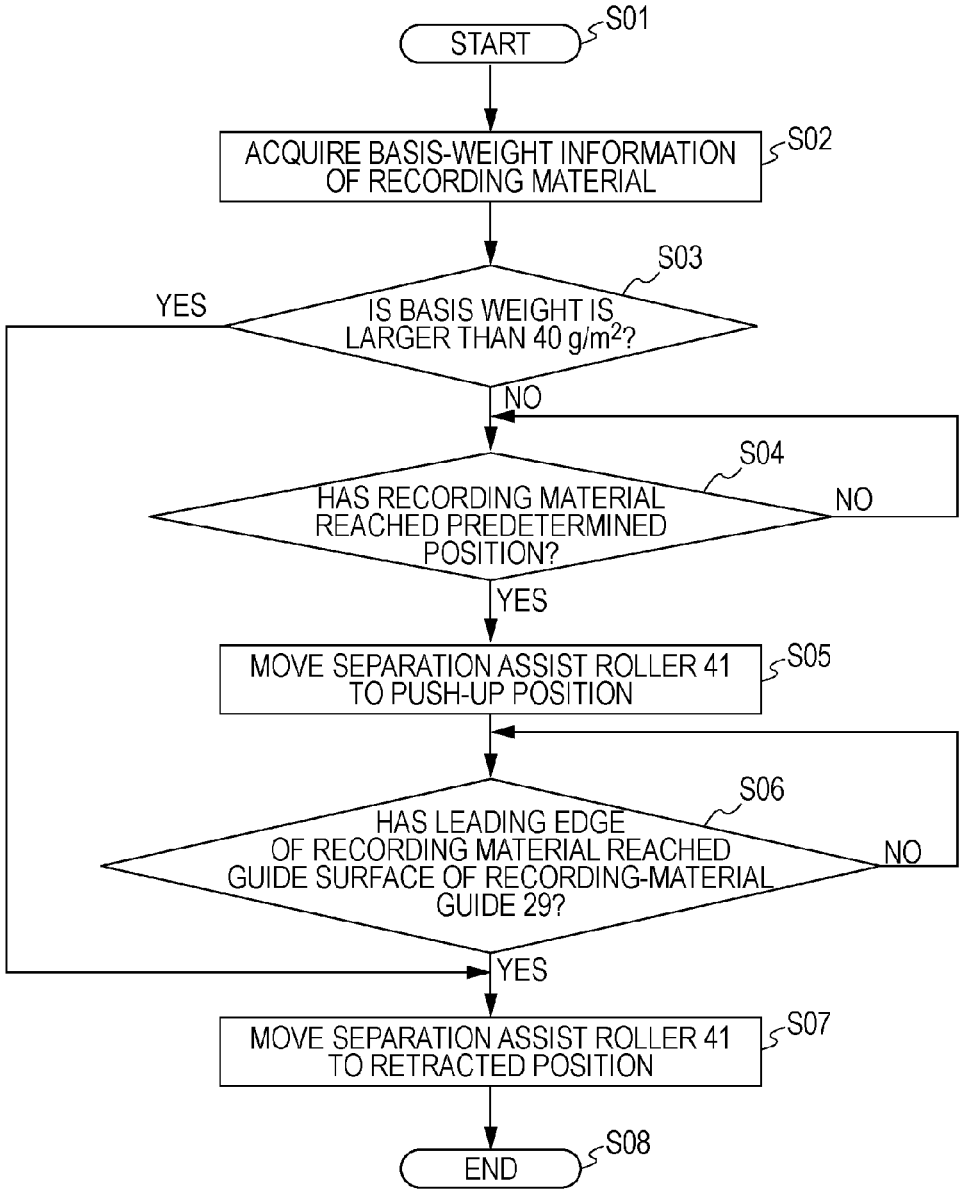
FIG. 7 explains a flowchart of control over the operation of the separation assist device 40 in the first embodiment.

A flowchart of control over the operation of the separation assist device 40 will be described with reference to FIG. 7. When a start is made (S01), the basis-weight information on the recording material set through the operation unit 102 by the user is read (S02). It is determined whether or not the basis weight is larger than the 40 g/m$^2$ (S03). When the basis weight of the recording material is larger than 40 g/m$^2$ in S03, the separation assist rollers are placed at a retracted position (S07). When the basis weight of the recording material P set by the user is smaller than or equal to 40 g/m$^2$, an operation of the separation assist rollers 41 for pushing up the transfer belt 24 to form a local protrusion is necessary to separate the recording material having low stiffness from the transfer belt 24. When the set basis weight of the recording material P is smaller than or equal to 40 g/m$^2$, it is determined whether or not the recording material has reached a predetermined position (S04). The predetermined position is set at a position that is upstream of the separation assist rollers 41 in the recording-material conveying direction so that the operation of the separation assist rollers 41 for pushing up the transfer belt 24 is completed before the leading edge of the recording material reaches a position pushed by the separation assist rollers 41. The position of the recording material is determined, for example, by a method of detection from the time that has elapsed since the recording material passed between the registration rollers and the conveying speed of the recording material or a method for detecting the position of the recording material with a detection member for detecting the passage of the recording material. When it is determined that the recording material has reached the predetermined position, the separation assist rollers 41 are moved in the Y1-direction and is placed at a push-up position where the transfer belt 24 is pushed up (S05). The recording material P is undulated on the transfer belt 24 deformed by the separation assist rollers 41, and thereby increases its stiffness. The recording material P is separated from the transfer belt 24 before reaching an area where the transfer belt 24 is in contact with the stretching roller 26. Next, it is determined whether or not the leading edge of the recording material P has reached the guide surface of the recording-material guide 29 (S06). The position of the recording material is determined, for example, by a method of detection from the time that has elapsed since the recording material passed between the registration rollers and the conveying speed of the recording material or a method for detecting the position of the recording material with a detection member for detecting the passage of the recording material. When the recording material has reached the guide surface of the recording-material guide 29, it is determined that separation has been performed, the separation assist rollers are moved to the retracted position (S07), and the control ends (S08).

While control is performed on the basis of the basis-weight information input by the user in this embodiment, the basis weight of the recording material may be detected using a sensor provided in the image forming apparatus. When the operation of the separation assist device 40 is controlled on the basis of the basis weight detected by the sensor, even if a recording material having a small basis weight is erroneously stored in a cassette for a recording material having a large basis weight, a push-up operation is performed. That is, even if a recording material having a small basis weight is stored in a wrong position, separation failure of the recording material having the small basis weight can be suppressed.

As the sensor, a weight sensor for detecting the weight of a conveyed recording material can be provided in the conveying path of the recording material, and the basis weight of the recording material can be determined on the basis of the weight detected by the weight sensor and the size information (area) on the recording material. Alternatively, a transmissive sensor for detecting the transmittance of light may be provided in the conveying path of the recording material, and the thickness of the recording material may be determined on the basis of the transmittance of light passing through the conveyed recording material.

Separation of Recording Material by Stretching Roller 26

In this embodiment, when a recording material having a specific thickness (first thickness) is conveyed, the separation assist rollers 41 move to the push-up position. In contrast, when a recording material having a thickness larger than the specific thickness (second thickness) is conveyed, the separation assist rollers 41 do not move to the push-up position. That is, while the recording material having the specific thickness is separated by raising the separation assist rollers 41 in this embodiment, the thick recording material also can be separated by pushing up the transfer belt 24 by the separation assist rollers 41. The push-up amount necessary to separate the thick recording material by the push-up motion is smaller than the push-up amount necessary to separate the thin recording material by the push-up motion. However, at least a certain push-up amount is necessary. A local protrusion formed in the transfer belt 24 by such push-up motion imposes a local load, which cannot be disregarded, on the transfer belt 24, and this accelerates local wear of the transfer belt 24. In contrast, it is found that the thick recording material can be separated from the transfer belt 24 using the curvature of the stretching roller for stretching the transfer belt 24 and the high rigidity of the recording material.

In this embodiment, as shown in FIG. 1, the stretching roller 26 is provided downstream of the separation assist rollers 41 in the recording-material conveying direction, and the recording material guide 29 for guiding the recording material to the fixing device 60 is provided further downstream of the stretching roller 26 and next to the stretching roller 26.

With this structure, when a recording material P having a high rigidity, such as a thick recording material, reaches an area of the transfer belt 24 that is curved by contact with the stretching roller 26 (an area where the running direction of the transfer belt 24 is changing), even if the recording material is not undulated in the width direction, it is separated from the transfer belt 24 by the curvature of the transfer belt 24 curved by the stretching roller 26 and the high stiffness of the recording material. That is, the position where the thick recording material separates from the transfer belt 24 is close to the leading end of the recording-material guide 29, and the recording material separated from the transfer belt 24 smoothly moves onto the guide surface of the recording-material guide. As a result, it is possible to prevent the recording material having a high rigidity, such as a thick recording material, from deviating out of the transfer belt 24 owing to the stiffness of the recording material and the conveying force of the transfer belt 24.

In contrast, a position where a recording material having a low rigidity, such as a thin recording material, separates from the transfer belt 24 is upstream, in the recording-material conveying direction, of the position where the thick recording material separates. That is, the position is far from the leading end of the recording-material guide 29. However, the deviation amount of the recording material having a low rigidity, such as a thin recording material, is small, and therefore, the conveying direction of the recording material does not vary greatly.

FIG. 2B illustrates a state in which the separation assist rollers push up the transfer belt 24, and FIG. 2B illustrates a state in which the separation assist rollers are retracted. The recording material is separated by pushing up the transfer belt 24, so that the separating position of the recording material becomes upstream of the stretching roller 26 in the recording-material conveying direction and becomes apart from the recording-material guide 29. In this embodiment, the retracted position is a position such that the separation assist rollers 41 are separate from the transfer belt 24 in order to avoid wear of the transfer belt 24. While the separation assist rollers 41 are separate from the transfer belt 24 at the retracted position in this embodiment, the separation assist rollers 41 may touch the transfer belt 24 at the retracted position to a light degree such as not to deform the transfer belt 24.

Second Embodiment

Descriptions of parts overlapping with those adopted in the first embodiment are omitted because they are similar to the first embodiment.

Even if recording materials have the same basis weight, when the materials of the recording materials are different, resistances of the recording materials themselves are different. As a result, even when the recording materials have the same basis weight, if a secondary-transfer bias is subjected to constant voltage control, secondary-transfer currents actually flowing when the recording materials pass through the secondary-transfer nip are not equal. It is considered that, when the secondary-transfer current flowing when the recording material passes through the secondary-transfer nip increases, electrostatic attractive force between the recording material and the transfer belt 24 increases, and separability decreases. Accordingly, the influence of the secondary-transfer current on separability of the recording material from the transfer belt 24 was studied. The result of study shows that, when the secondary-transfer current exceeds 40 μA, it is difficult for the stretching roller 26 to separate, from the transfer belt 24, a recording material whose basis weight is more than 40 g/m$^2$ and less than 60 g/m$^2$. Accordingly, in this embodiment, a transfer-current detecting unit for detecting the transfer current is provided, and the operation control over the separation assist device 40 is determined on the basis of a transfer current detected by the transfer-current detection unit when the leading edge of the recording material passes through the secondary-transfer nip.

Figure 9:
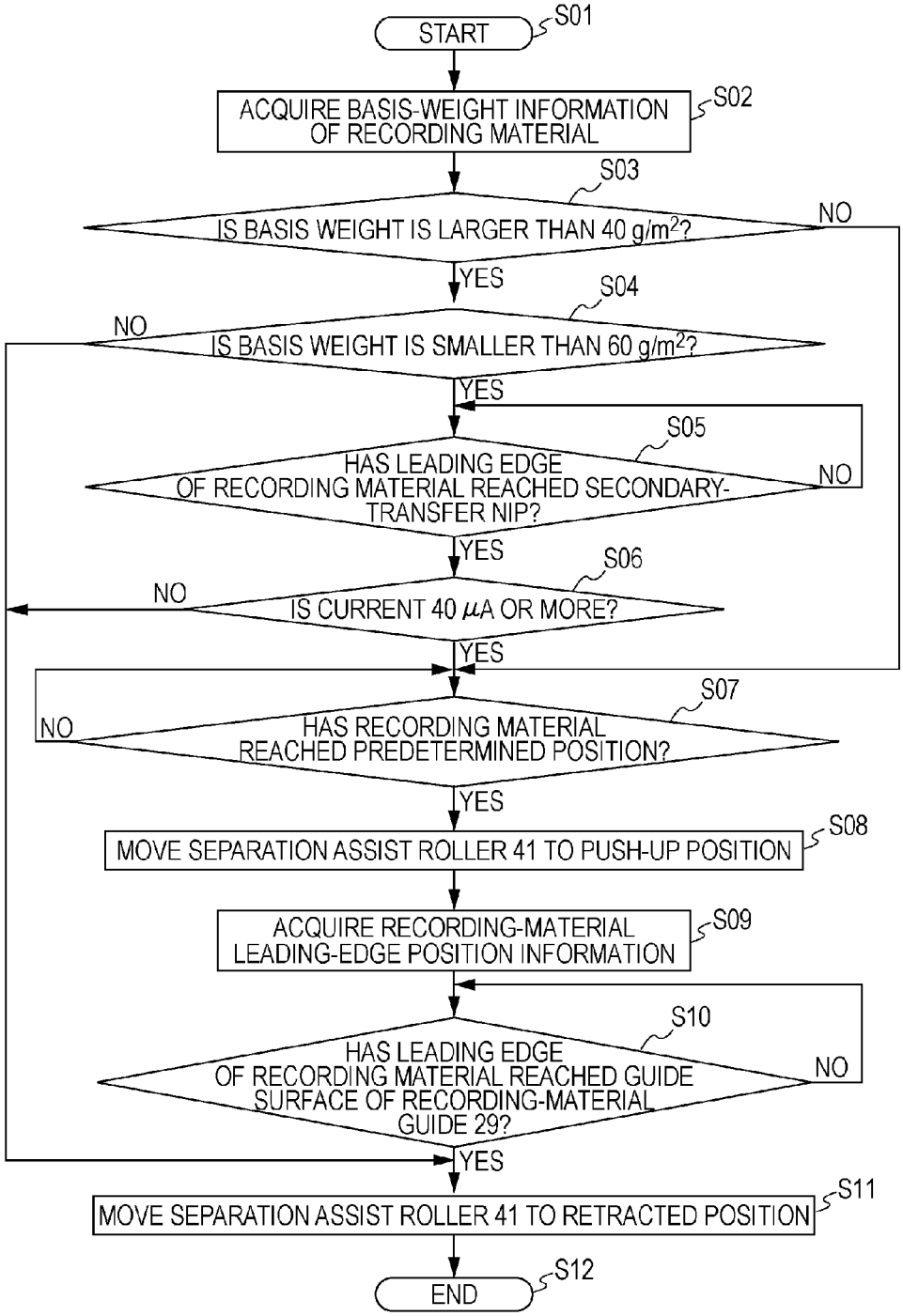
FIG. 9 explains a flowchart in a second embodiment.

That is, in this embodiment, the operating position of the separation assist device 40 is controlled on the basis of a matrix shown in Table 1 and according to a flowchart shown in FIG. 9.

TABLE 1

| | | Basis weight of recording material | | |
|---|---|---|---|---|
| | | 40 g/m$^2$ or less | More than 40 g/m$^2$ and less than 60 g/m$^2$ | 60 g/m$^2$ or less |
| Secondary transfer current | More than 40 μA | Deform | Deform | Separate |
| | 40 μA or less | Deform | Separate | Separate |

Table 1 is a table prestored in a storage unit provided in the control unit 50. This control table distinguishes, according to the transfer-current value provided when the leading edge of the recording material passes through the transfer nip, a case in which the transfer belt 24 is deformed by the separation assist rollers 41 (deform) and a case in which the separation assist rollers 41 are separate from the transfer belt 24 (separate). When the basis weight of the recording material is more than or equal to 60 g/m$^2$, a "separate" state is provided. In a case in which the basis weight of the recording material is more than 40 g/m$^2$ and less than 60 g/m$^2$, a "separate" state is provided when the transfer current at the leading edge of the recording material is 40 μA or less, and a "deform" state is provided when the transfer current at the leading edge of the recording material is more than 40 μA. When the basis weight of the recording material is less than 40 g/m$^2$, a "deform" state is provided. That is, when the read transfer current is a predetermined current value (first current value), a "deform" state is provided. When the read transfer current is a current value (second current value) lower than the first current value, a "separate" state is provided.

The flowchart of operation control over the separation assist device 40 will be described with reference to FIG. 9. When a start is made (S01), basis-weight information on a recording material set by the user through a user operation unit 102 is read (S02). It is determined whether or not the read basis weight is more than 40 g/m$^2$ (S03). When the basis weight of the recording material P set by the user is less than or equal to 40 g/m$^2$, an operation of the separation assist rollers 41 for pushing up the transfer belt 24 is necessary to separate the recording material from the transfer belt 24. When the set basis weight of the recording material P is less than or equal to 40 g/m$^2$, it is determined whether or not the recording material has passed between registration rollers and has reached a predetermined position (S07). The predetermined position is set at a position upstream of the separation assist rollers 41 in the recording-material conveying direction so that the push-up operation of the separation assist rollers 41 for the transfer belt 41 is completed before the leading edge of the recording material reaches a position pushed up by the separation assist rollers 41. The position of the recording material is determined, determined, for example, by a method of detection from the time that has elapsed since the recording material passed between the registration rollers and the conveying speed of the recording material, a method for detecting the position of the recording material with a detection member for detecting the passage of the recording material, or a method of detection from the time that has elapsed since the secondary-transfer current was read and the conveying speed of the recording material. Since the separation assist rollers are not moved to the push-up position until it is determined that the recording material has not reached the predetermined position, wear of the transfer belt 24 can be suppressed. When it is determined that the recording material has reached the predetermined position, the separation assist rollers 41 are moved in the Y1-direction and are placed at the position to push up the transfer belt 24 (S08). The recording material P is undulated on the transfer belt 24 deformed by the separation assist rollers 41 to increase its stiffness, and is separated from the transfer belt 24 before reaching the stretching roller 26.

When the basis weight of the recording material is more than 40 g/m$^2$ in S03, it is then determined whether or not the basis weight is less than 60 g/m$^2$ (S04). When the basis weight is more than or equal to 60 g/m$^2$, the separation assist rollers 41 are placed at a retracted position (S11). When it is determined that the basis weight of the recording material P set by the user is more than 40 g/m$^2$ and less than 60 g/m$^2$, it is determined whether or not the leading edge of the recording material has reached the secondary-transfer nip (S05). When it is determined that the leading edge of the recording material has reached the secondary-transfer nip, it is determined whether or not a secondary-transfer current detected by the transfer-current detection unit when the leading edge of the recording material passes through the secondary-transfer nip is more than or equal to 40 μA (S06). When the current is less than 40 μA, the separation assist rollers 41 are placed at the retracted position (S11). In contrast, when the transfer current detected by the transfer-current detection unit is more than or equal to 40 μA, it is then determined whether or not the recording material has reached the predetermined position (S07). When it is determined that the recording material has reached the predetermined position, the separation assist rollers 41 are placed at the push-up position (S08). By placing the separation assist rollers 41 at the push-up position, separation using the separation assist rollers 41 is performed. Then, leading-edge position information on the recording material is acquired (S09). The leading-edge position information on the recording material is acquired by, determined, for example, by a method of detection from the time that has elapsed since the recording material passed between the registration rollers and the conveying speed of the recording material or a method for detecting the position of the recording material with a detection member for detecting the passage of the recording material. Then, it is determined whether or not the leading edge of the recording material has reached a guide surface of a recording-material guide 29 (S10). When the leading edge of the recording material has reached the guide surface of the recording-material guide 29, the separation assist rollers are moved to the retracted position (S11), and the control ends (S12). In this embodiment, when the basis weight of the recording material is more than 40 g/m$^2$ and is less than 60 g/m$^2$, the operation control over the separation assist rollers is determined on the basis of the transfer current detected by the transfer-current detection unit when the leading edge of the recording material passes through the secondary-transfer nip. However, to determine the operation control over the separation assist rollers when the basis weight is more than 40 g/m$^2$ and less than 60 g/m$^2$, the determination may be made using a secondary-transfer current detected before the recording material passes through the secondary-transfer nip.

Operation Control Timing of Separation assist Rollers 41

Figure 8:
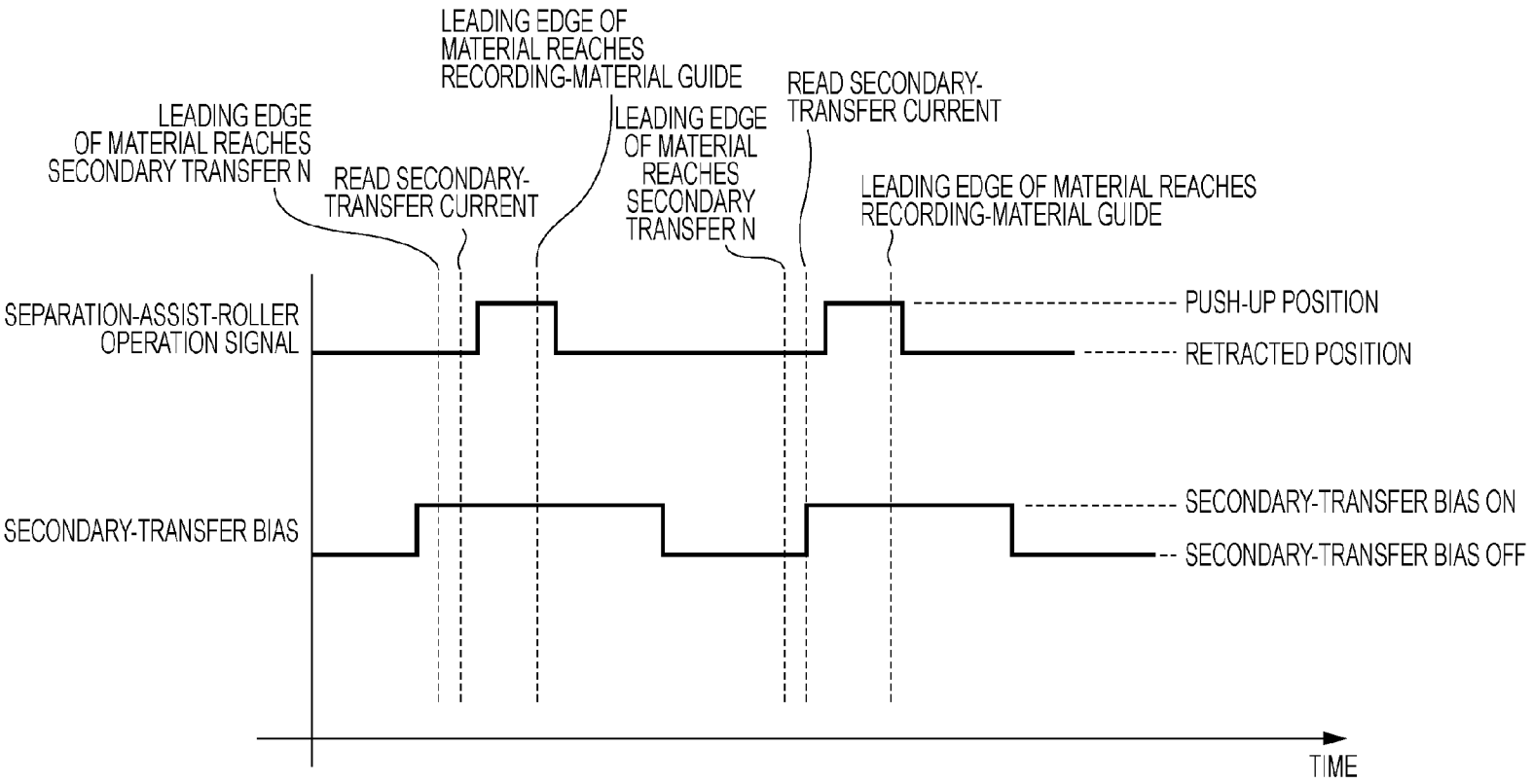
FIG. 8 explains a timing at which the separation assist rollers are controlled in the first embodiment.

With reference to FIG. 8, a description will be given of a timing at which the separation assist rollers are controlled when the basis weight is more than 40 g/m$^2$ and less than 60 g/m$^2$ and the secondary-transfer current is more than or equal to 40 μA. When a secondary-transfer bias subjected to constant voltage control is applied (ON) and the leading edge of the recording material reaches the secondary-transfer nip, a secondary-transfer current is read by the transfer-current detection member. When the secondary-transfer current read after the leading edge of the recording material reaches the secondary-transfer nip is more than or equal to 40 μA, a separation-assist-roller operating signal for moving the separation assist rollers 41 to the push-up position is transmitted from the control unit 50 to the separation assist rollers 41. After that, when it is determined that the leading edge of the recording material has reached the guide surface of the recording-material guide 29, a separation-assist-roller operating signal for moving the separation assist rollers 41 to the retracted position is transmitted from the control unit 50 to the separation assist rollers 41.

Third Embodiment

A third embodiment of the present invention will be described. Descriptions of parts overlapping with those adopted in the second embodiment are omitted because they are similar to the second embodiment.

The third embodiment is different from the second embodiment in a timing at which separation assist rollers 41 are moved to a push-up position when it is determined that the basis weight is more than 40 g/m$^2$.

When the basis weight is 40 g/m$^2$, it is unnecessary to read the secondary-transfer current. Accordingly, in this embodiment, when it is determined that the basis weight is more than 40 g/m$^2$, movement of the separation assist rollers 41 to the push-up position is completed before a recording material reaches a secondary-transfer nip. Since vibration is not caused by movement of the separation assist rollers 41 while secondary transfer is conducted on the recording material, when the basis weight is 40 g/m$^2$, it is possible to suppress the influence of vibration due to the movement of the separation assist rollers 41 on the secondary transfer.

Fourth Embodiment

Figure 10A:
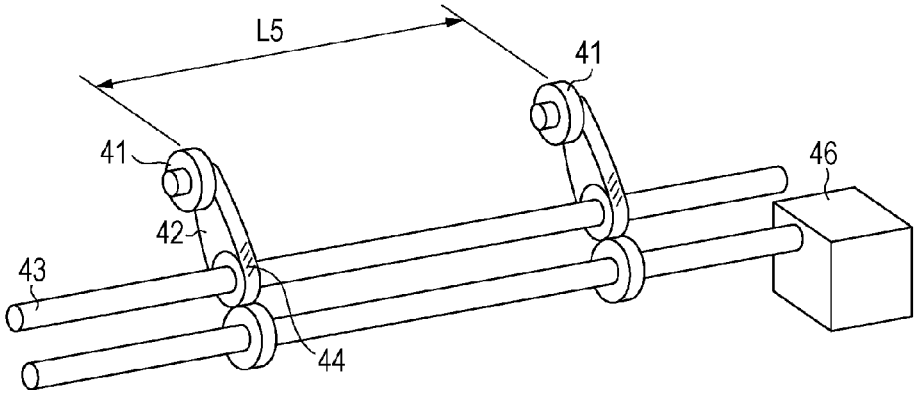
FIG. 10A is a perspective view of a separation assist device according to a fourth embodiment.

A fourth embodiment of the present invention will be described with reference to FIG. 10A. Descriptions of parts overlapping with those adopted in the first embodiment are omitted because they are similar to the first embodiment. In this embodiment, two separation assist rollers 41 are arranged with a predetermined interval being disposed therebetween in the width direction. An interval L5 between the separation assist rollers 41 is 250 mm that is shorter than the width of a recording material. This can be ready particularly for an A4-sized thin recording material having a size of 297 mm in the width direction.

Fifth Embodiment

Figure 10B:
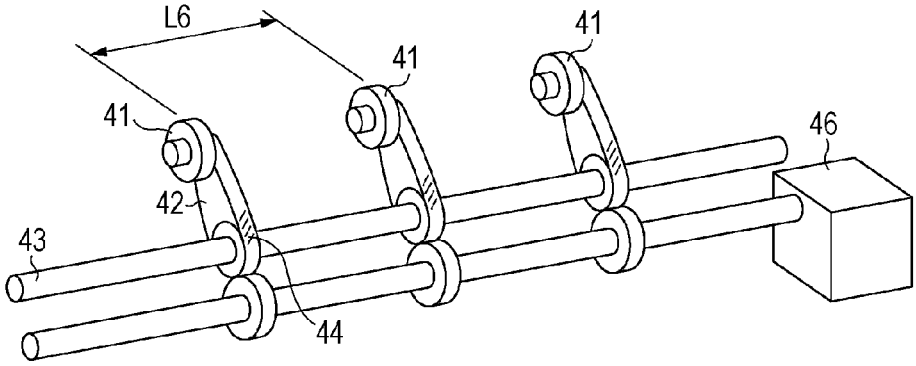
FIG. 10B is a perspective view of a separation assist device according to a fifth embodiment.

A fifth embodiment of the present invention will be described with reference to FIG. 10B. Descriptions of parts overlapping with those adopted in the first embodiment are omitted.

In this embodiment, three separation assist rollers 41 are arranged in the width direction. An interval L6 between the adjacent separation assist rollers 41 is 125 mm. An interval between the endmost separation assist rollers 41 is 250 mm. The center separation assist roller 41 is located to be at almost the center of a recording material conveyed in a manner such that the center thereof in the width direction substantially coincides with a common reference line, regardless of the width of the recording material. Particularly when an A4-sized thin recording material having a size of 297 mm in the width direction is conveyed, two valley shapes are formed in the recording material P on a transfer belt 24. By forming a plurality of valley shapes in the A4-sized recording material, separability of the A4-sized recording material can be enhanced further. Although not shown here, four or more separation assist rollers 41 may be provided within the width of the recording material.

Sixth Embodiment

Figure 10C:
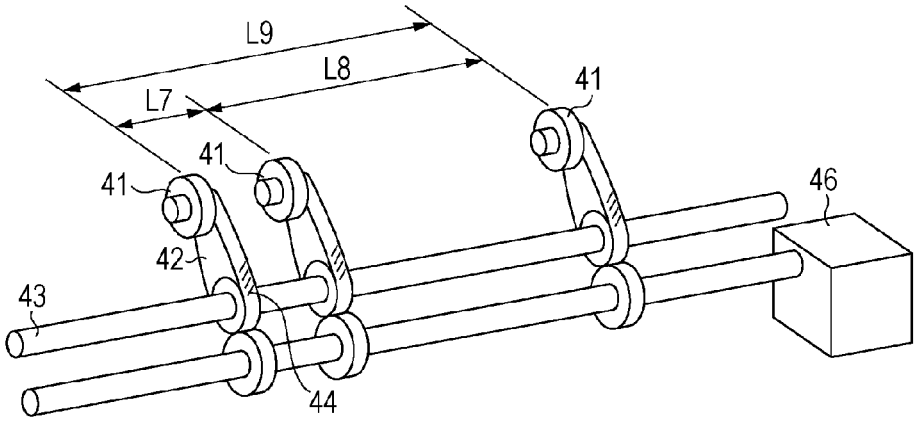
FIG. 10C is a perspective view of a separation assist device according to a sixth embodiment.

A sixth embodiment of the present invention will be described with reference to FIG. 10C. Descriptions of parts overlapping with those adopted in the second embodiment are omitted because they are similar to the second embodiment.

In this embodiment, three separation assist rollers 41 are arranged in the width direction. A shorter interval (L7) between the adjacent separation assist rollers 41 is 80 mm, and a longer interval (L8) between the adjacent separation assist rollers 41 is 170 mm. An interval L9 between the separation assist rollers 41 provided at ends is 250 mm.

Figure 11A:
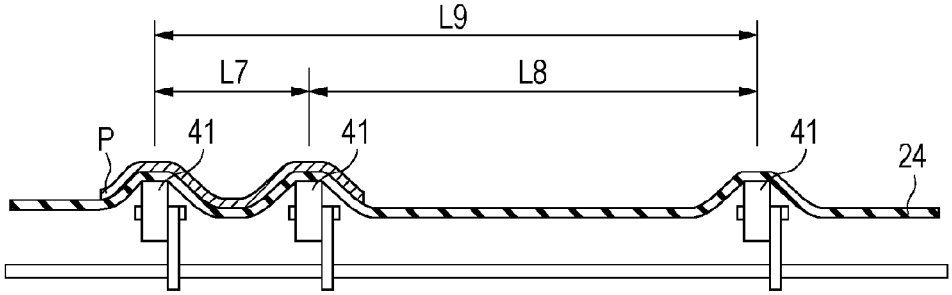
FIG. 11A illustrates the arrangement of the separation assist rollers 41 in the width direction in the sixth embodiment.

FIG. 11A illustrates a case in which a size in the width direction of a recording material P to be conveyed is longer than or equal to 100 mm and shorter than 170 mm. In this case, the recording material P is conveyed in a manner such that the midpoint between the separation assist rollers 41 adjacent with the shorter interval L7 therebetween coincides with the center in the width direction of the recording material P to be conveyed.

Figure 11B:
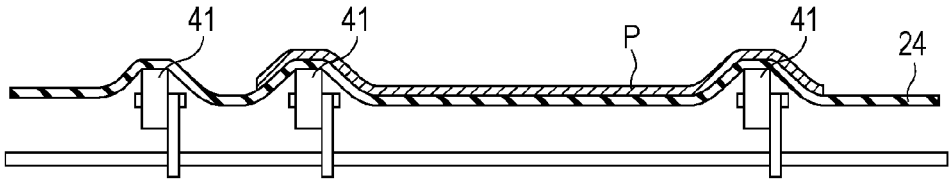
FIG. 11B illustrates the arrangement of the separation assist rollers 41 in the width direction in the sixth embodiment.

FIG. 11B illustrates a case in which the size in the width direction of the recording material P to be conveyed is longer than or equal to 170 mm and shorter than 250 mm. In this case, the recording material P is conveyed in a manner such that the midpoint between the separation assist rollers 41 adjacent with the longer interval L8 therebetween coincides with the center in the width direction of the conveyed recording material P.

Figure 11C:
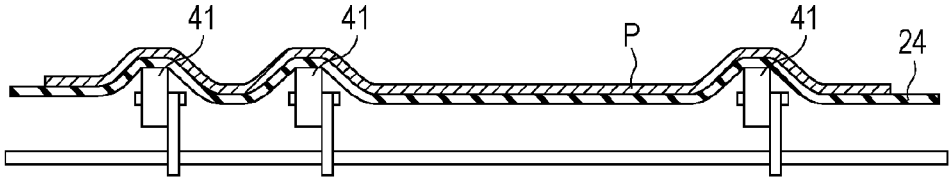
FIG. 11C illustrates the arrangement of the separation assist rollers 41 in the width direction in the sixth embodiment.

FIG. 11C illustrates a case in which the size in the width direction of the recording material P to conveyed is longer than or equal to 250 mm. In this case, the recording material P is conveyed in a manner such that the midpoint between the separation assist rollers 41 at the ends coincides with the center in the width direction of the conveyed recording material P.

With this structure, a plurality of protrusions are formed on a transfer belt 24 for recording materials having sizes in the width direction from a postcard size as the minimum size to a width of 330 mm.

Seventh Embodiment

A seventh embodiment of the present invention will be described with reference to FIG. 12. Descriptions of parts overlapping with those adopted in the second embodiment are omitted because they are similar to the second embodiment.

Figure 12A:
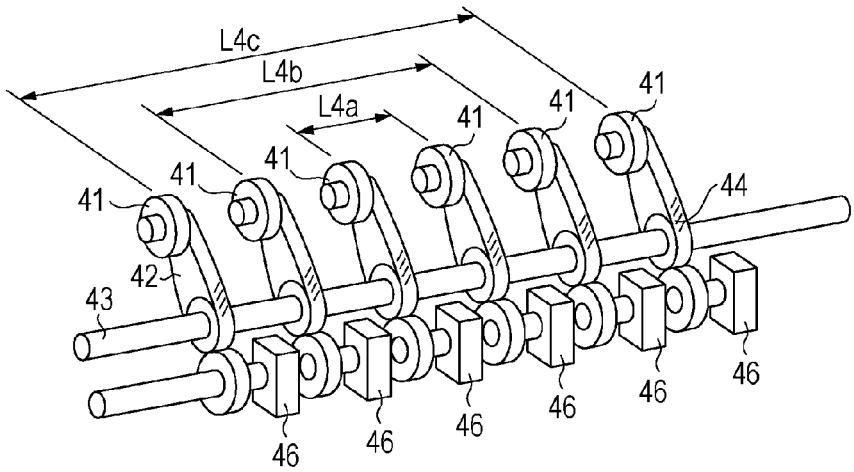
FIG. 12A is a perspective view of a seventh embodiment.

In this embodiment, as shown in FIG. 12A, motors 46 for position change are provided for respective separation assist rollers 41. Six separation assist rollers 41 are spaced in the width direction. An interval L4*a* between two center adjacent separation assist rollers 41 is 80 mm, an interval L4*b* between the second separation assist rollers 41 from the ends is 150 mm, and an interval L4*c* between the separation assist rollers 41 at the ends is 250 mm. A recording material having any width is conveyed so that the center thereof in the width direction substantially coincides with a common reference line. The center of the recording material coincides with the midpoint between the end separation assist rollers 41, the midpoint between the second separation assist rollers 41 from the ends, and the midpoint between the two center adjacent separation assist rollers 41.

Driving of the motor 46 corresponding to each separation assist roller 41 is performed without any interference of driving of other separation assist rollers 41 because of a bearing provided between a roller driving gear 44 and a roller pivot center shaft 43. Operating positions of the separation assist roller 41 are controlled according to information on the size in the width direction of the recording material specified through an operation unit 102 by the user. That is, control is performed so that the separation assist rollers 41 located in an area in the width direction where the conveyed recording material passes are placed at push-up positions, and the separation assist roller 41 located in a non-passage area where the conveyed recording material does not pass are placed at retracted positions.

Figure 12B:
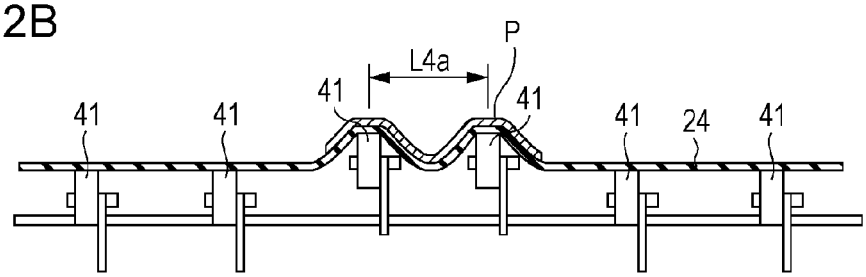
FIG. 12B illustrates the arrangement of the separation assist rollers 41 in the width direction in the seventh embodiment.
Figure 12C:
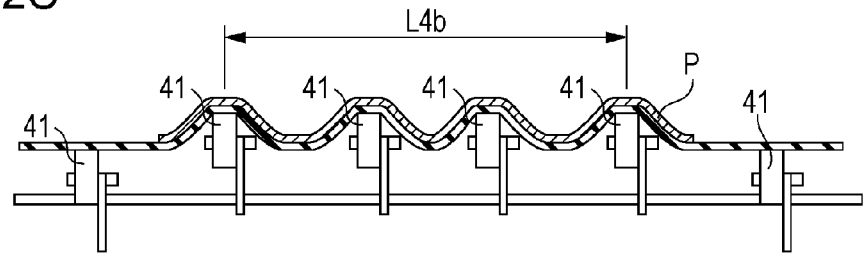
FIG. 12C illustrates the arrangement of the separation assist rollers 41 in the width direction in the seventh embodiment.
Figure 12D:
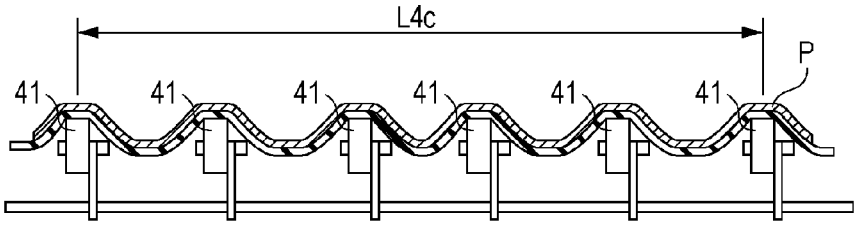
FIG. 12D illustrates the arrangement of the separation assist rollers 41 in the width direction in the seventh embodiment.

When the size in the width direction of the conveyed recording material P is longer than or equal to 100 mm and shorter than 150 mm, as shown in FIG. 12B, two center separation assist rollers 41, of the sixth separation assist rollers 41, are raised. When the size in the width direction of the conveyed recording material is longer than or equal to 150 mm and shorter than 250 mm, as shown in FIG. 12C, four center separation assist rollers 41, of the six separation assist rollers 41, are raised. When the size in the width direction of the conveyed recording material P is longer than or equal to 250 mm, as shown in FIG. 12D, four center separation assist rollers 41 of the six separation assist rollers 41 are raised.

Even when a thin recording material is conveyed, the separation assist rollers 41 in the area where the recording material passes are raised, but the separation assist rollers 41 in the area where the recording material does not pass are not raised, so that it is possible to suppress a load applied to the belt when the thin recording material is separated by the separation assist rollers.

In an image forming apparatus that performs separation of a thin recording material from a transfer belt and separation of a thick recording material from the transfer belt at different positions, stabilization of conveyability of the thin recording material after separation and conveyability after separation of the thick recording material separated by a member different from a member for separation of the thin recording material can both achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

an image bearing member configured to bear a toner image;

a movable belt member configured to bear and convey a recording material;

a transfer member configured to electrostatically transfer the toner image formed on the image bearing member onto the recording material born and conveyed by the belt member;

a push-up member having a plurality of protrusions in a width direction of the belt member and configured to push up, from an inner side, the belt member downstream of the transfer member in a conveying direction of the recording material so that the plurality of protrusions forms a plurality of protruded portions on the belt member in a thickness direction of the belt member;

an execution portion configured to execute a first mode in which the plurality of protrusions of the push-up member forms a plurality of protruded portions in a width direction of the belt member by pushing up the belt member and a second mode in which the plurality of protrusions of the push-up member is separated from the belt member;

a control portion configured to execute the first mode in case that a recording material having a first stiffness is conveyed by the belt member, and to execute the second mode in case that a recording material having a second stiffness larger than the first stiffness is conveyed by the belt member.

2. An image forming apparatus comprising:

an image bearing member configured to bear a toner image;

a movable belt member configured to bear and convey a recording material;

a transfer member configured to electrostatically transfer the toner image formed on the image bearing member onto the recording material born and conveyed by the belt member;

a push-up member having a plurality of protrusions in a width direction of the belt member and configured to push up, from an inner side, the belt member downstream of the transfer member in a conveying direction of the recording material so that the plurality of protrusions forms a plurality of protruded portions on the belt member in a thickness direction of the belt member;

an execution portion configured to execute a first mode in which the plurality of protrusions of the push-up member forms a plurality of protruded portions in a width direction of the belt member by pushing up the belt member and a second mode in which the plurality of protrusions of the push-up member is separated from the belt member;

a control portion configured to execute the first mode in case that a recording material having a first thickness is conveyed by the belt member, and to execute the second mode in case that a recording material having a second thickness larger than the first thickness is conveyed by the belt member.

3. An image forming apparatus comprising:

an image bearing member configured to bear a toner image;

a movable belt member configured to bear and convey a recording material;

a transfer member configured to electrostatically transfer the toner image formed on the image bearing member onto the recording material born and conveyed by the belt member;

a push-up member having a plurality of protrusions in a width direction of the belt member and configured to push up, from an inner side, the belt member downstream of the transfer member in a conveying direction of the recording material so that the plurality of protrusions forms a plurality of protruded portions on the belt member in a thickness direction of the belt member;

an execution portion configured to execute a first mode in which the plurality of protrusions of the push-up member forms a plurality of protruded portions in a width direction of the belt member by pushing up the belt member and a second mode in which the plurality of protrusions of the push-up member is separated from the belt member;

a control portion configured to execute the first mode in case that a recording material having a first basis weight is conveyed by the belt member, and to execute the second mode in case that a recording material having a second basis weight larger than the first basis weight is conveyed by the belt member.

4. The image forming apparatus according to claim 1, further including a transfer-current detection member configured to detect a current flowing to the transfer member, wherein the control portion executes the first mode in case that a first current value is detected by the transfer-current detection member when the transfer member transfers a toner image to a recording material, and executes the second mode in case that a second current value larger than the first current value is detected by the transfer-current detection member when the transfer member transfers a toner image to a recording material.

5. The image forming apparatus according to claim 1, wherein the push-up member includes a plurality of protrusions within an area where a recording material of a smallest size in the width direction among recording materials to be used in the image forming apparatus passes.

6. The image forming apparatus according to claim 1, wherein, in the first mode, at least two protrusions of the push-up member form a plurality of protruded portions in an area corresponding to a width of a recording material conveyed by the belt member.

7. The image forming apparatus according to claim 1, wherein a center of a recording material in the width direction is conveyed on the basis of a center of the belt member in the width direction, and wherein, in the first mode, each of a plurality of protrusions is disposed symmetrically on the basis of the center of the belt member in the width direction.

8. The image forming apparatus according to claim 1, wherein the push-up member includes a first protrusion a second protrusion adjacent to the first protrusion in the width direction, and wherein, in the first mode, a total value of lengths of the first and second protrusions in contact with the belt member in the width direction is smaller than a length between the first and second protrusions.

9. The image forming apparatus according to claim 1, wherein a distance between protrusions closest to each edge in the width direction of the recording material of the smallest size in the width direction among the recording materials to be used in the image forming apparatus is smaller than a width of the recording material of the smallest size.

10. The image forming apparatus according to claim 1, wherein a distance between protrusions closest to each edge in the width direction of a recording material of a largest size in the width direction among the recording materials to be used in the image forming apparatus is smaller than a width of the recording material of the largest size.

11. The image forming apparatus according to claim 1, wherein, in the first mode, protrusions of the push-up member in an area where inside in the width direction of a recording material is pushing up the belt member and protrusions of the push-up member in an area where outside in the width direction of a recording material is separated from the belt member.

12. The image forming apparatus according to claim 1, wherein the push-up member includes a shaft for supporting the plurality of protrusions of the push-up member, and a direction of an axis of the shaft intersects a recording-material conveying direction, wherein each of the plurality of protrusions of the push-up member has a cylindrical shape to rotate around the axis of the shaft, and wherein, in the first mode, the plurality of protrusions of the push-up member is rotated in conjunction with movement of the belt member while the plurality of protrusions of the push-up member is pushing up the belt member.

* * * * *